US006388431B1

(12) United States Patent
Kramer et al.

(10) Patent No.: US 6,388,431 B1
(45) Date of Patent: May 14, 2002

(54) HIGH EFFICIENCY POWER SUPPLY FOR A TWO-WIRE LOOP POWERED DEVICE

(75) Inventors: L. Jonathan Kramer, Warminster; Kevin G. Hafer, Douglassville, both of PA (US)

(73) Assignee: Ametek, Inc., Paoli, PA (US)

( * ) Notice: Subject to any disclaimer, the term of this patent is extended or adjusted under 35 U.S.C. 154(b) by 0 days.

(21) Appl. No.: 09/673,755

(22) PCT Filed: Nov. 3, 1999

(86) PCT No.: PCT/US99/25815

§ 371 Date: Oct. 20, 2000

§ 102(e) Date: Oct. 20, 2000

(87) PCT Pub. No.: WO00/26739

PCT Pub. Date: May 11, 2000

Related U.S. Application Data

(60) Provisional application No. 60/106,769, filed on Nov. 3, 1998.

(51) Int. Cl.[7] ..... G05F 1/40

(52) U.S. Cl. ..... 323/266

(58) Field of Search ..... 323/266, 268, 323/270, 271, 273, 275, 282, 285

(56) References Cited

U.S. PATENT DOCUMENTS

| | | | | |
|---|---|---|---|---|
| 4,420,753 A | | 12/1983 | Meyer-Ebrecht | 340/870.26 |
| 4,794,372 A | | 12/1988 | Kazahaya | 340/870.16 |
| 4,812,721 A | | 3/1989 | Graham et al. | 318/66 |
| 5,416,723 A | | 5/1995 | Zyl | 364/492 |
| 5,635,896 A | | 6/1997 | Tinsley et al. | 340/310.05 |
| 5,684,451 A | | 11/1997 | Seberger et al. | 340/310.06 |
| 6,046,549 A | * | 4/2000 | James | 315/291 |
| 6,215,288 B1 | * | 4/2001 | Ramsey et al. | 323/224 |

FOREIGN PATENT DOCUMENTS

| | | |
|---|---|---|
| EP | 0 895 201 A1 | 2/1999 |
| WO | PCT/US99/25815 | 11/1999 |
| WO | WO 00/26739 | 5/2000 |

* cited by examiner

*Primary Examiner*—Matthew Nguyen
(74) *Attorney, Agent, or Firm*—Woodcock Washburn LLP

(57) ABSTRACT

A process control device is disclosed. The process control device comprises a measuring circuit (102) and a power regulator circuit (100). The measuring circuit (102) is coupled to the power regulator (100), and produces a control signal indicative of a measured value. The power regulator circuit (100) redirects a portion of the available power from the power regulator circuit (100) in proportion to the control signal produced by the measuring circuit (102) such that it does not limit available power to the measuring circuit (102). The process control device also may comprise a power control circuit (101) coupled to the measuring circuit (102). The power control circuit (101) redirects an amount of available power from the power regulator circuit (100) in proportion to the control signal. The process control device also comprisies two or more conductors (106, 107) that are in electrical communication with the power regulator circuit (100) and the power control circuit (101). These conductors (106, 107) deliver the available power to the power regulator circuit (100) and the power control circuit (101), as well as receiving a first electric signal from the power regulator circuit (100) and a second electric signal from the power control circuit (101).

37 Claims, 8 Drawing Sheets

HIGH EFFICIENCY POWER SUPPLY FOR A TWO-WIRE LOOP POWERED DEVICE

This appln is a 371 of PCT/US99/25815 Nov. 3, 1999 which claims benefit of No. 60/106,769 Nov. 3, 1998.

FILED OF THE INVENTION

The present invention relates to the field of instrumentation and control. More particularly, the invention relates to a high-efficiency device that draws power and transmits a signal over the same conductors.

BACKGROUND OF THE INVENTION

Two-wire transmitters and controllers are well known in the field of instrumentation and control. Generally, a two-wire transmitter is a low-power device located proximate a substance, and used to measure one or more conditions of the substance (e.g., fluid level, temperature, pressure, flow). A two-wire controller is a low-powered device used for controlling such conditions (e.g., a remotely operated valve). The transmitter and controller uses the same conductors both to receive power from a power source and to transmit and/or receive signals to or from one or more indicating and/or control devices (e.g., display, meter, programmable controller, computer).

In order to accomplish these functions, two-wire transmitters and two-wire controllers traditionally incorporate certain components. Two-wire devices typically are coupled to an external power supply by a pair of conductors that form a loop between the device and the power supply. Two-wire devices are also coupled to a transducer device. In the case of the transmitter, the transducer monitors the conditions to be measured. The transducer provides a signal to the transmitter proportional to the condition of the substance to be measured. Acting as a variable current sink, the effective series resistance across the transmitter varies so as to produce a change in the current drawn by the transmitter representative of the condition being monitored. In the case of the controller, the transducer controls the state of the condition. The controller provides a signal to the transducer proportional to the desired state of the condition.

Current industry standards place certain constraints on the operation of two-wire devices. One such constraint is that the current in the two-wire loop must be between approximately 4 milliamperes and 20 milliamperes under normal operating procedures. Moreover, it is desirable that a 4–20 milliampere transmitter be capable of operating on slightly less than 4 milliamperes and also be able to draw slightly more than 20 milliamperes to facilitate calibration. For example, in the case of a transmitter using HART™ protocol, a 1 milliampere peak-to-peak AC current must be superimposed on the operating current, requiring the transmitter to be capable of operating at instantaneous currents as low as 3.5 milliamperes.

A second constraint requires two-wire devices to be capable of operating from a standard power supply, usually 24 volts direct current (DC). These power supplies often have intrinsic safety barriers which may have an internal resistance of several hundred ohms. In addition, two-wire devices often must operate in circuit loops that may have wire resistance up to a few hundred ohms. For example, if an indicating device is used, the total loop resistance often reaches 600 ohms, thus reducing the terminal voltage at the two-wire device to 12 volts DC when the loop current is 20 milliamperes. As a result of this limited voltage supply, power available to the two-wire device is severely limited.

A third constraint is that two-wire devices typically contain electronic circuitry, which must operate from a reduced voltage (e.g., 3, 5, 10 volts) that cannot vary as the available voltage changes. As a result, the transmitter must employ circuitry to reduce the voltage available from the loop to the required voltage levels. Because the amount of power provided to the circuitry influences its capability, speed and accuracy, the regulation circuitry must function with as little power loss as possible.

To date, this regulation process has been performed by a linear regulating circuit, or by a linear regulating circuit in series with a non-linear regulating circuit. These linear regulating circuits unnecessarily reduce the power available to the circuitry by dissipating power equal to the product of the current used multiplied by the difference between the input voltage and the voltage required to operate the measuring circuit. For example, for a measuring circuit operating on 10 volts DC where the transmitter receives 21 volts DC, the power associated with the additional 11 volts would be dissipated in the form of heat.

Therefore, it is one object of the invention to provide a two-wire device in which the available power is not reduced as a consequence of the required power conversion.

Many two-wire devices store energy in order to permit high, intermittent peak energy use without requiring sudden increases in loop current. When power is first applied to the two-wire device, local energy storage devices can cause high loop current to flow, called inrush current. Large inrush currents can trigger thyristor-type intrinsic safety barriers, and can interfere with digital signaling systems.

Therefore, it is another object of the invention to provide internal energy storage without causing large inrush currents.

SUMMARY OF THE INVENTION

The present invention provides a process control device that does not reduce the available power during the required power regulation. The process control device comprises a measuring circuit and a power regulator circuit. The measuring circuit, which is coupled to the power regulator circuit, produces a control signal indicative of a measured value. The power regulator circuit is created such that it does not limit available power to the measuring circuit. The process control device also may comprise a power control circuit coupled to the measuring circuit. The power control circuit redirects a portion of the available power from the power regulator circuit in proportion to the control signal produced by the measuring circuit. The process control device also comprises two or more conductors that are in electrical communication with the power regulator circuit and the power control circuit. These conductors deliver the available power to the power regulator circuit and the power control circuit, as well as receiving a first electric signal from the power regulator circuit and a second electric signal from the power control circuit. The first and second electric signal may be electric currents, whose combined value falls in the range of 4–20 milliamperes. In addition, the available power may be provided by a direct-current power source.

The power regulator circuit may comprise a non-linear, power regulator, for example, a switching regulator. The power control circuit may comprise a voltage to current converter. The control signal provided by the measuring circuit may be an electric voltage, and the measured value may be provided to the measuring circuit by a sensor, for example a transducer. The power regulator circuit may also comprise a current limiting circuit for reducing current surges present when the process control device begins to operate.

According to an aspect of the invention, a method is provided for use in a process control system. The method comprises receiving power, regulating the power with a power regulator circuit to a first value to operate a measuring circuit, providing to a power control circuit a control signal produced by the measuring circuit, and converting the control signal to an electric signal to operate an indicator. Notably, the power regulator circuit does not limit the power to the measuring circuit.

According to an aspect of the invention, a process control system is provided. The process control system comprises a sensor adapted to determine a measured value, a process control device (as described above) in electrical communication with the sensor, and a power source coupled to the process control device by two or more conductors. The conductors deliver the available power from the power source to the process control device, and receive an electric signal from the process control device. The process control system further comprises an indicating device for describing the electric signal. The indicating device is coupled to the power source and the process control device.

DETAILED DESCRIPTION OF PREFERRED EMBODIMENT

Figure 1:
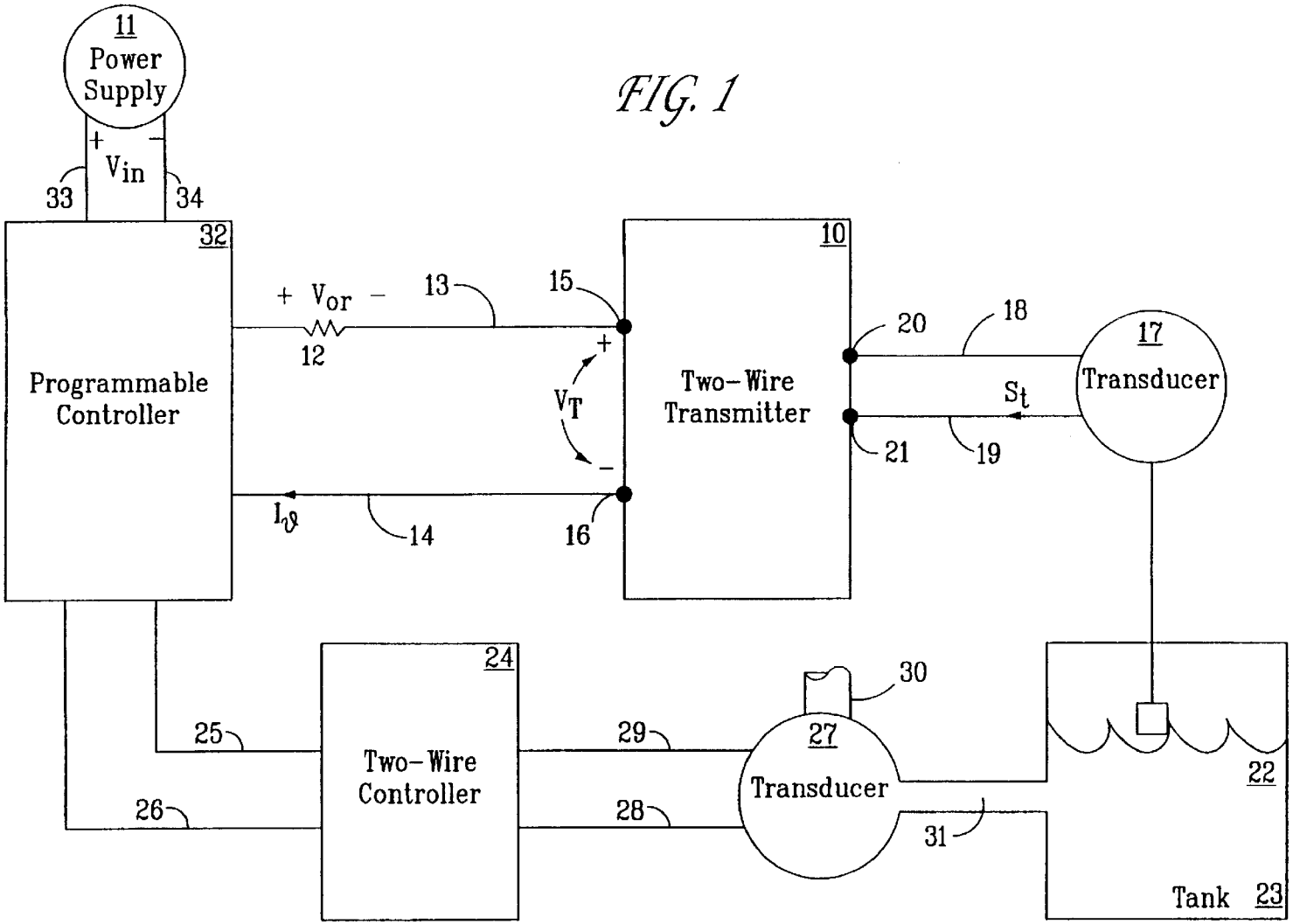
FIG. 1 is a block diagram of a two-wire transmitter and controller system according to the present invention.

As shown in FIG. 1, a two-wire system may include a two-wire transmitter 10 and a two-wire controller 24. Two-wire transmitter 10 is coupled to a programmable controller 32 by conductors 13 and 14, which are connected to terminals 15 and 16 of two-wire transmitter 10. Two-wire controller 24 also is coupled to programmable controller 32 by conductors 25 and 26. Programmable controller is further coupled to a power supply 11 by conductors 33 and 34. Power supply 11 provides a voltage $V_{in}$, preferably in the range of 12–40 volts direct-current (DC), more preferably 24 volts DC.

Two-wire transmitter is also coupled to a load represented by resistor 12. Resistor 12 represents one or more indicating devices, including power meters, visual displays, and HART™ communication devices. Although the value of resistor 12 will vary depending on the type and quantity of indicating devices, a 600 ohm load is an industry-accepted approximation. Therefore, a voltage drop $V_{dr}$ results across resistor 12, leaving a voltage $V_1$ at terminals 15 and 16 of two-wire transmitter 10. The value of voltage drop $V_{dr}$, and thus of terminal voltage $V_t$, will depend on the value of loop current $I_l$. Transmitter 10 is adapted to draw loop current $I_l$ in the range of 4–20 milliamperes, in accordance with industry-standard indicating devices. The value of loop current $I_l$ at any particular instant is dependent upon a signal received by transmitter 10 from a transducer 17.

Two-wire transmitter 10 is coupled to transducer 17 through conductors 18 and 19 connected to terminals 20 and 21 of two-wire transmitter 10. Transducer 17 monitors a condition (e.g., level, temperature, pressure) of a substance 22, located in tank 23. As the monitored condition changes, transducer 17 sends a signal $S_t$ to two-wire transmitter 10. In accordance with the received signal $S_t$, two-wire transmitter 10 adjusts the amount of current it draws from power supply 11 in accordance with a predetermined setting. Industry-standard two-wire transmitters commonly draw 4 milliamperes when the monitored condition is at its lowest point (e.g., empty tank) and 20 milliamperes when the monitored condition is at its highest point (e.g., full tank). Accordingly, when signal $S_t$ from transducer 17 indicates a low-point condition, two-wire transmitter 10 will draw 4 milliamperes, and when signal $S_t$ from transducer 17 indicates a high-point condition, two-wire transmitter 10 will draw 20 milliamperes.

Programmable controller 32 provides a logic interface between two-wire transmitter 10 and two-wire controller 24. As transducer 17 monitors the level of substance 22 in tank 23, two-wire transmitter 10 varies loop current $I_l$ (as discussed above). In accordance with the value of loop current $I_l$, programmable controller 32 provides a voltage signal to two-wire controller 24. Two-wire controller 24 measures voltage available in a loop formed by conductors 25 and 26. Two-wire controller 24 then sends a signal to transducer 27 on conductors 29 and 28. Transducer 27 may then operate to adjust the level of substance 22 in tank 23. For example, transducer 27 may operate a valve (not shown) that opens a fill pipe 30 and allows tank 23 to receive additional substance 22 through supply pipe 31.

Figure 2:
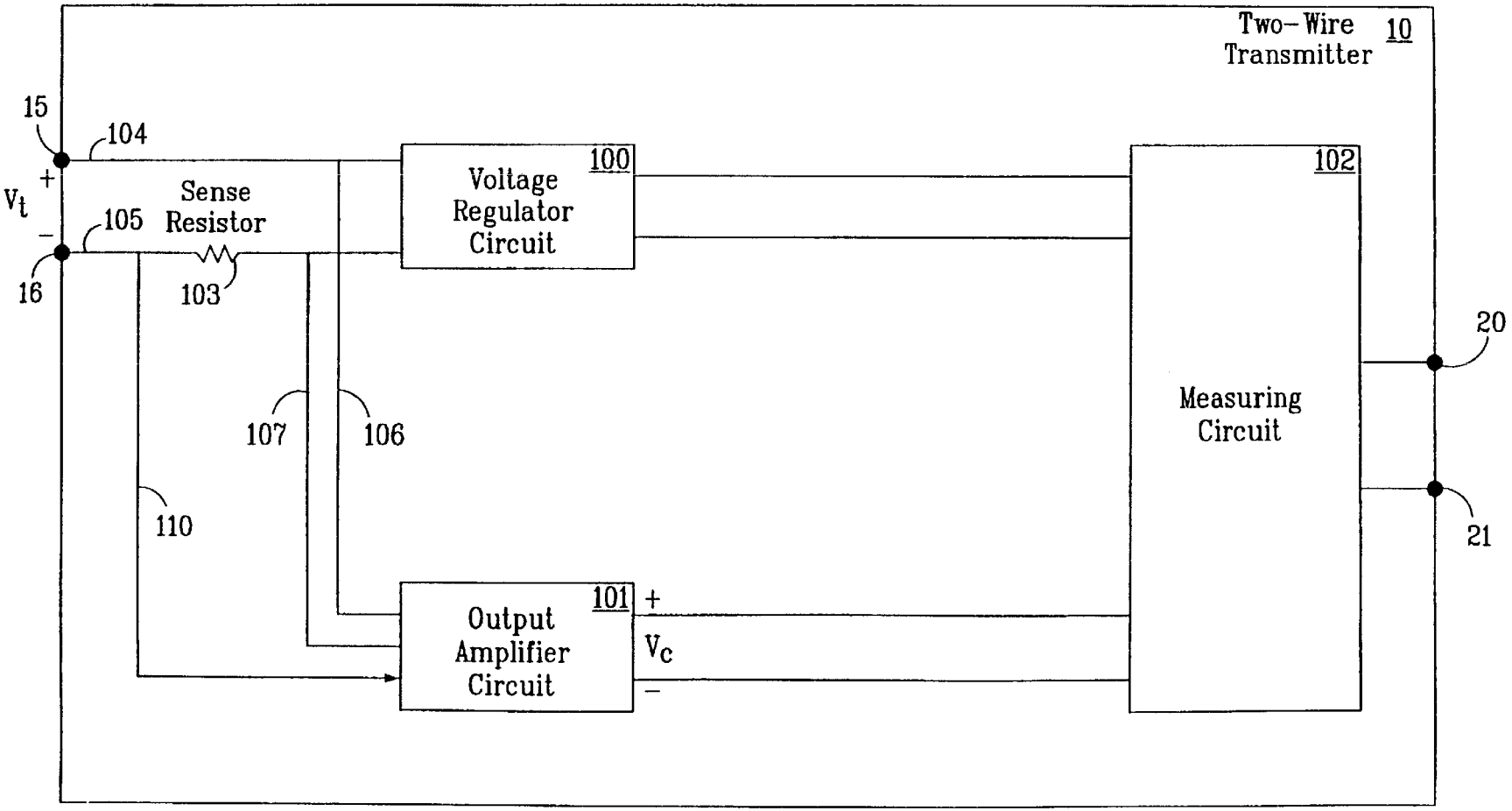
FIG. 2 is a block diagram of a two-wire transmitter device according to the present invention.

FIG. 2 shows a block diagram of two-wire transmitter 10. Two-wire transmitter 10 comprises a voltage regulator circuit 100, an output amplifier circuit 101, and a measuring circuit 102. Voltage regulator circuit 100 and output amplifier circuit 101 couple directly to terminal 15 of two-wire transmitter 10, and couple through a sense resistor 103 to terminal 16 of two-wire transmitter 10. In addition, voltage regulator circuit 100 and output amplifier circuit 101 are coupled to measuring circuit 102. Measuring circuit 102 is coupled to terminals 20 and 21 of two-wire transmitter 10.

When measuring circuit 102 receives signal $S_t$ from transducer 17 (as shown in FIG. 1), measuring circuit 102 provides an output control voltage $V_c$ to output amplifier circuit 101. Output amplifier circuit 101 acts as a variable load and draws a portion of loop current $I_l$ (as shown in FIG. 1) on conductor 106 in proportion to the value of output control voltage $V_c$. The precise value of the portion of loop current $I_l$ drawn by output amplifier circuit 101 depends on the amount of loop current $I_l$ drawn by voltage regulator circuit 100. For example, using a 70 milliwatt measuring circuit operating at 10 volts DC and 7 milliamperes, a 20 milliampere loop current $I_l$ will cause voltage regulator circuit 100 to draw 6.13 milliamperes. Therefore, in order to maintain the 20 milliampere loop current $I_l$, output amplifier circuit 101 will draw the remaining 13.87 milliamperes.

Because terminal voltage $V_t$ varies with loop current $I_l$, two-wire transmitter 10 employs voltage regulator circuit 100 to provide a constant voltage and constant current, necessary to operate measuring circuit 102. Preferably, for a 70 milliwatt measuring circuit 102, a constant voltage of 10 volts DC and a constant current of 7 milliamperes is provided by voltage regulator circuit 100 to measuring circuit 102.

Figure 3:
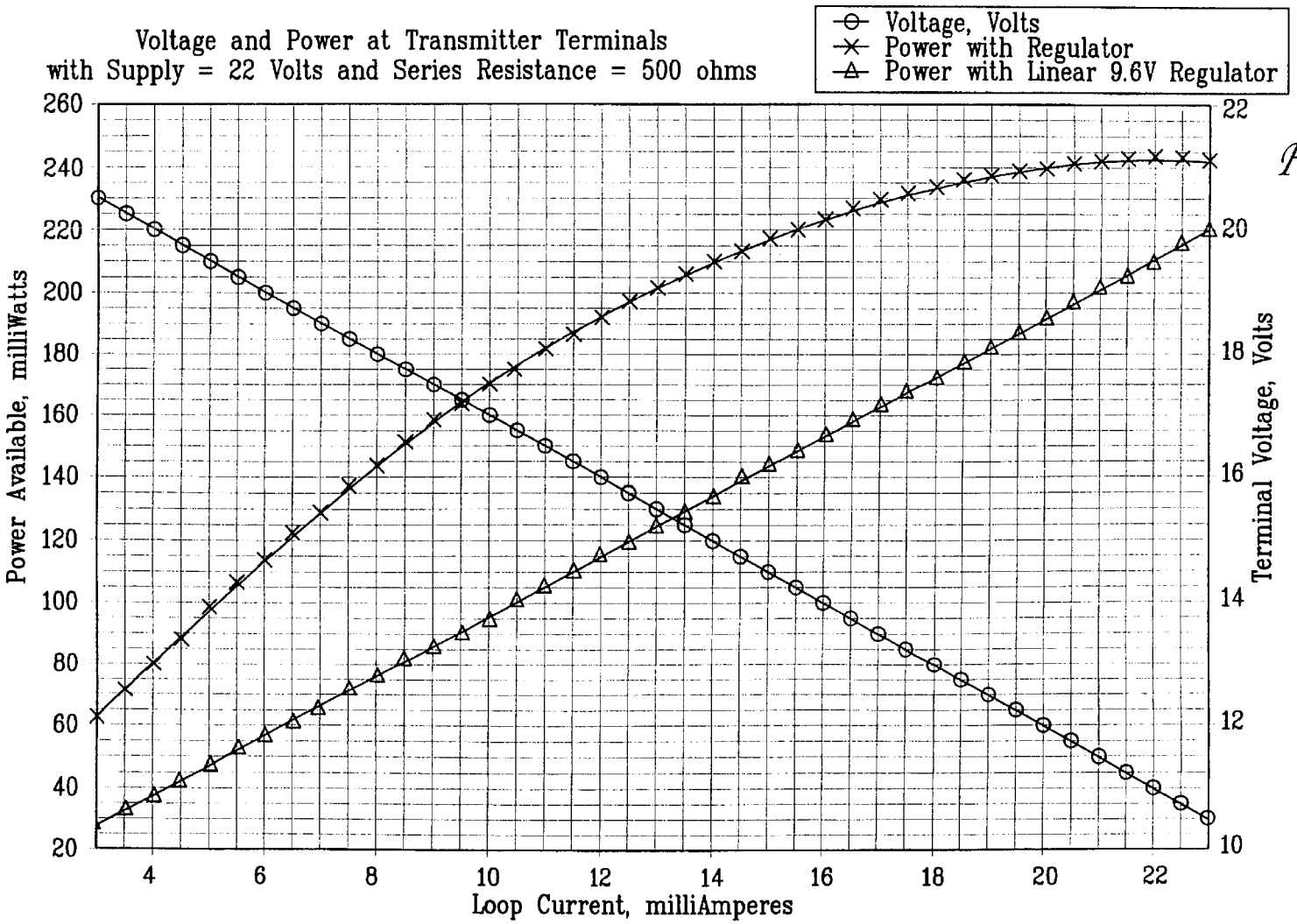
FIG. 3 is graph of the power conserved by using a non-linear power converter circuit in the two-wire device.

Non-linear circuits regulate voltage and current more efficiently than linear regulator circuits, and thus non-linear regulators do not limit the power available to measuring circuit 102 across the entire 4–20 milliamperes range of permitted loop currents. FIG. 3 is a graph illustrating power available to measuring circuit 102 (left vertical axis), loop current $I_1$ (horizontal axis), and terminal voltage $V_t$ (right vertical axis) at two-wire transmitter 10 (as shown in FIG. 1). FIG. 3 shows a curve 301 representing power available with a non-linear regulator, a line 302 representing power available with a linear regulator, and a line 303 indicating the value of terminal voltage $V_t$. Considering one example when loop current $I_l$ is 4 milliamperes and terminal voltage $V_t$ is 21.6 volts, the linear regulator circuit dissipates 40.6 milliwatts of power, thus providing 45.8 milliwatts to measuring circuit 102. However, at the same loop current $I_l$ of 4 milliamperes and the same terminal voltage $V_t$ of 21.6 volts, a 95% efficient non-linear regulator circuit dissipates just 1.75 milliwatts of power, thus providing 85.65 milliwatts of power to measuring circuit 102. Although this graph represents available power for a 24 volt power supply and a 600 ohm series resistance, it should be appreciated that non-linear regulators are more efficient than linear regulators independent of the power supplied or the series resistance.

The additional power available with a non-linear regulating circuit permits measuring circuit 102 to have an increased capacity. For example, with a 24 volt power supply and a 600 ohm series resistance, a non-linear regulator with a 95% power efficiency will permit the use of a 70 mW measuring circuit. A linear regulating circuit, on the other hand, only permits the use of a 35 mW measuring circuit for the same 24 volt power supply and 600 ohm series resistance. As compared to the 35 mW measuring circuit, the 70 mW measuring circuit has increased capabilities including the ability to measure a broader range of condition values (e.g., larger fluid depths) and the ability to provide faster and more accurate measurements to the indicating devices.

Figure 4:
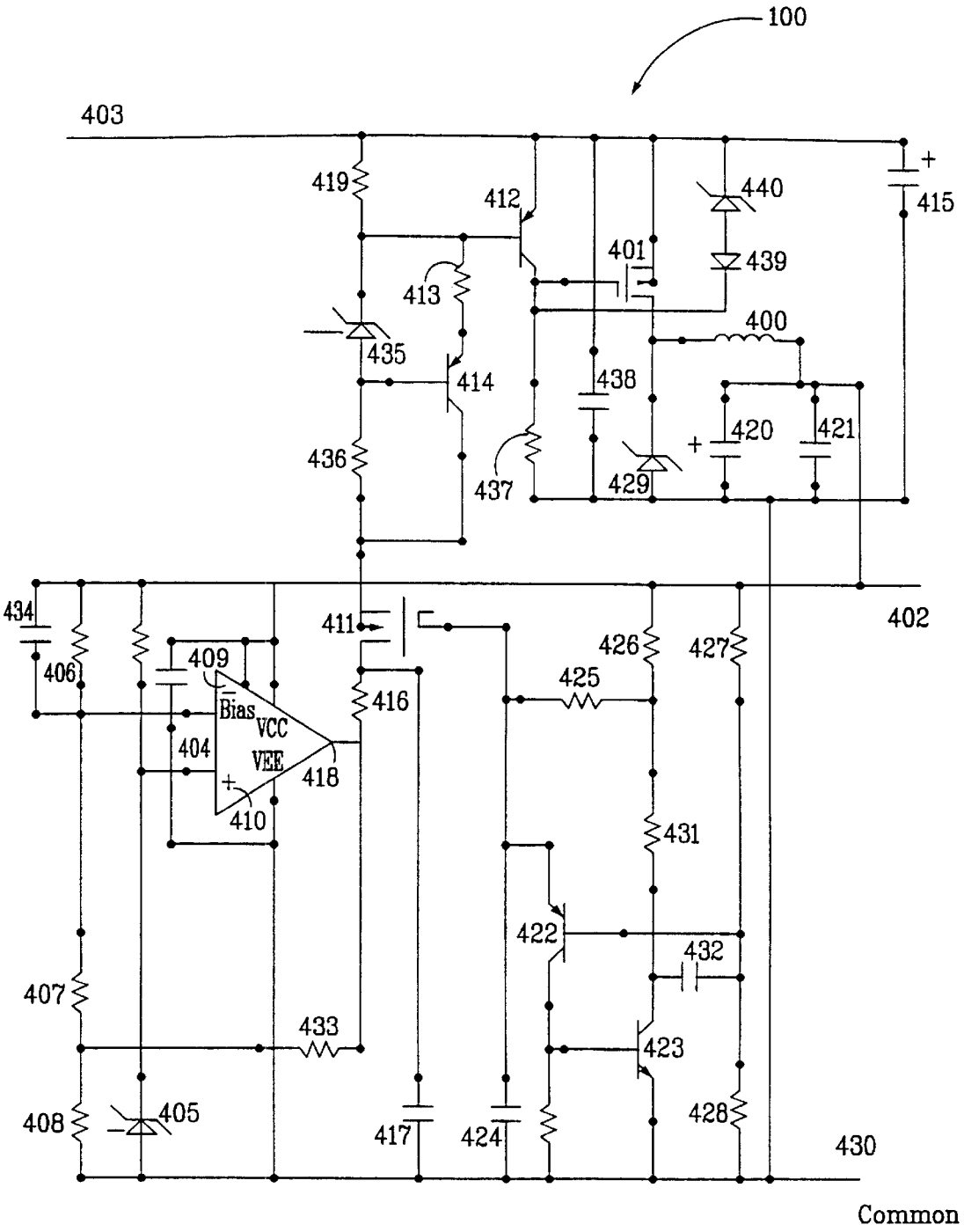
FIG. 4 is a schematic diagram of a preferred embodiment of a high-efficiency non-linear regulator circuit.

FIG. 4 is a detailed schematic of a preferred embodiment of a high efficiency non-linear regulator circuit 100. In this circuit, power is transferred to an inductor 400 whenever the gate of transistor 401 goes low. While the gate of transistor 401 is allowing current to flow through inductor 400, regulated voltage 402 rises. Energy is stored in inductor 400 and returned to the load through Schottky diode 429 when transistor 401 is off. When regulated voltage 402 reaches a set point, the gate of transistor 401 will turn off and non-linear regulator circuit 100 will draw the needed power from inductor 400, causing regulated voltage 402 to begin to decrease. When regulated voltage 402 decreases below a lower set point, the gate of transistor 401 will again turn on, and the above cycle will be repeated. Inductor 400 is switched rapidly from supply line 403 by transistor 401 to common terminal 430 by Schottky diode 429.

Resistors 427 and 428 bias the base of transistor 422 at one-third of the voltage at terminal 402. Resistors 425 and 426 charge capacitor 424 until voltage on the emitter of transistor 422 rises one-half volt above its base, thus allowing transistor 422 to conduct. As the voltage on the emitter of transistor 422 rises, current through transistor 422 increases until transistor 423 conducts. Increasing current through transistor 423 causes an increasing voltage drop across resistors 426 and 431. Because resistors 426 and 431 are coupled by capacitor 432 to the base of transistor 422, current through transistor 422 rises rapidly, saturating transistors 422 and 423. Voltage on the emitter of transistor 422 is clamped to voltage at the base of transistor 423 (approximately 0.6 volts). When capacitor 432 has discharged, voltage at the base of transistor 422 begins to rise. Capacitor 424 prevents the voltage at the emitter of transistor 422 from rising as quickly as the base, thus causing transistors 422 and 423 to turn off. The process then repeats, producing an approximately 4 volt sawtooth wave.

One requirement for non-linear regulator circuit 100 is that DC voltage 402 preferably is maintained at 9.45 volts. Operation amplifier 404 achieves this requirement. Operational amplifier 404 compares voltage on diode 405 with that of voltage divider formed by resistors 406, 407, 433, and 408. Capacitor 434 provides a zero voltage in a closed-loop response to partially cancel one of the poles from the filter formed by inductor 400 and capacitors 420 and 421. Resistor 433 provides negative feedback, limiting the gain and maintaining control loop stability. Non-linear regulator circuit 100 is designed so that the output of operational amplifier 404 will vary from 1 volt, when voltage at terminal 402 is 9.56 volts, to 6 volts when the voltage at terminal 402 is 9.5 volts.

Resistor 416, capacitor 417, and transistor 411 perform a comparator function. When voltage at the source of transistor 411 is more positive than threshold voltage at its gate, transistor 411 is turned off. Transistor 411 begins to conduct when voltage at its source is less positive than the threshold voltage at its gate. At this point, its current is being limited to less than 90 microamperes by reference diode 435, resistors 413 and 436, transistor 414. Capacitor 417 provides a low impedance source for the pulsating current flow of transistor 411. Resistor 416 isolates capacitor 417 from operational amplifier 404.

Resistors 419 and 437, and transistor 412 drive transistor 401. Current pulses from transistor 411 saturate transistor 412, shorting the gate drive to transistor 401. When transistor 412 turns off, resistor 437 pulls the gate of transistor 401 down to common terminal 430. Because voltage across resistor 437 is several times the threshold voltage of transistor 401, transistor 401 turns on rapidly. Similarly, a rapid turn-off of transistor 401 is assured by the low impedance of saturated transistor 412, thus minimizing switching losses. Schottky diode 429 provides a low loss path for inductor 400 to supply current when transistor 401 turns off. Capacitors 438 and 415 provide a low impedance source of current to transistor 401. Similarly, capacitors 420 and 421 provide a low impedance over a wide frequency range to filter the output of non-linear regulator circuit 100.

Because operation amplifier 404 must sink almost all current that flows through transistor 411, transistor 412 can not be turned on until the supply is regulating. Therefore, the supply is self-starting.

It is desirable to use transistor 401, where transistor 401 is set such that its maximum permissible gate voltage exceeds the maximum supply voltage to the device. However, if this cannot be accomplished, an optional gate voltage limiter comprising an avalanche diode 440 in series with a switching diode 439 may be added. Switching diode 439 isolates the gate voltage from the high capacitance of avalanche diode 440, thus preventing it from slowing down the drive wave while still protecting the gate.

Figure 5:
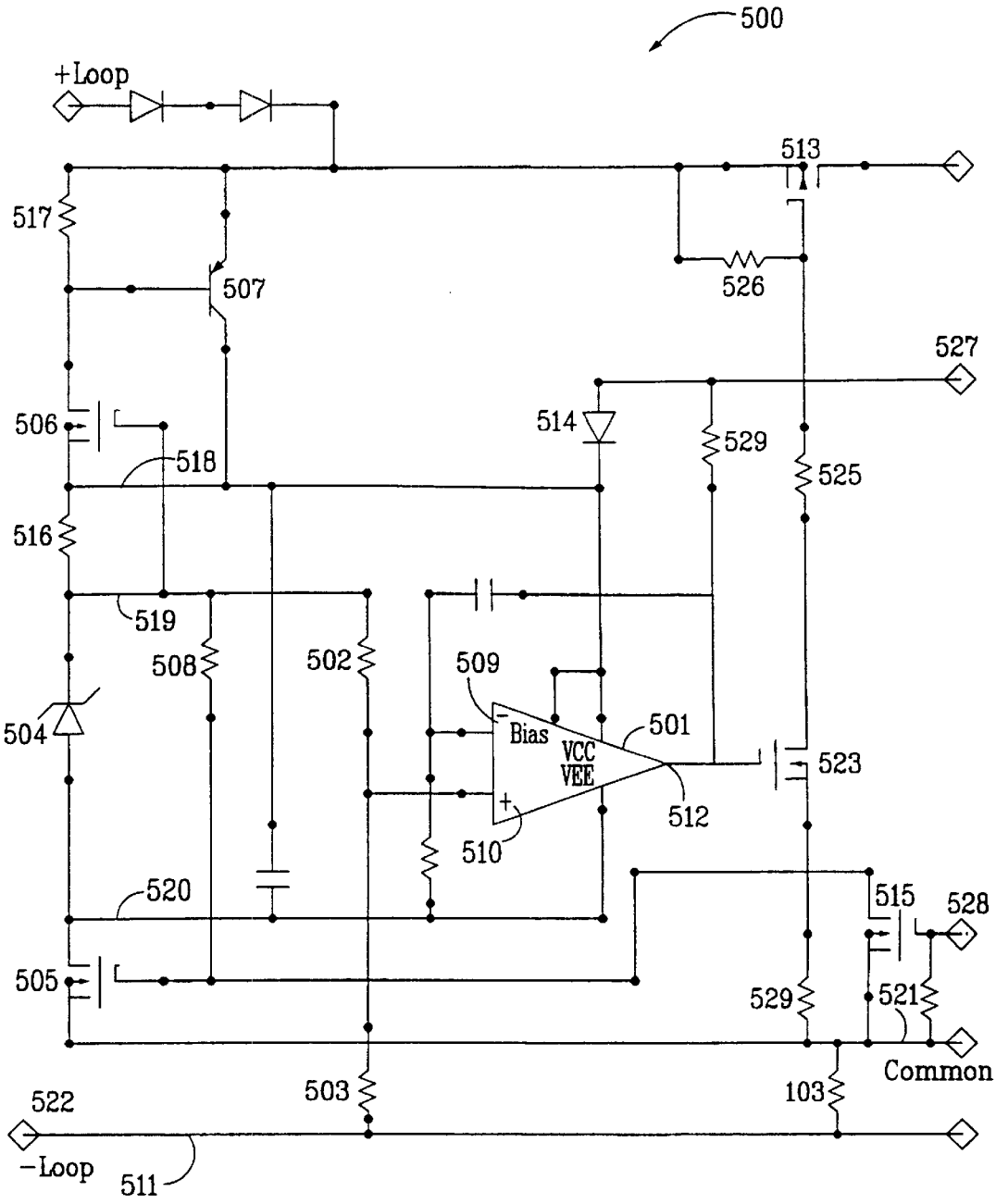
FIG. 5 is a schematic diagram of a preferred embodiment of a current limiting circuit.

FIG. 5 is a schematic diagram of a preferred embodiment of a current limiting circuit 500, which is an integral part of voltage regulator circuit 100. Generally, current limiting circuit 500 is used at startup to ensure that inrush current does not exceed the specifications of a given system. At start-up, depletion-mode transistor 506 becomes saturated and turns on transistor 507. Voltage on conductor 518 increases as does voltage on conductor 519 until transistor 505 is turned on. As a result, current flows through resistor 516 into zener diode 504 and starts turning off transistor 506. Transistor 506 thus acts as a source follower amplified by transistor 507 to maintain the voltage on conductor 518 at approximately 7 volts. Transistor 505 becomes saturated and maintains a voltage on conductor 520, thus maintaining the voltage on conductor 520 at approximately the same voltage as the common on conductor 521. Negative input 509 of operational amplifier 501 is held at the same voltage as conductor 520, while the voltage at positive input 510 of operational amplifier 501 is biased between the voltage at terminal 522 (-loop) and the voltage on conductor 519 by voltage divider resistors 502 and 503.

As long as a current drawn by two-wire transmitter 10 is too small to cause a voltage across current sensing resistor 103 to approach the product of the voltage across zener diode 504 multiplied by the ratio of resistor 503 to resistor 502, voltage at positive input 510 of operational amplifier 501 will be positive with respect to a voltage at conductor 521. As a result, output 512 of operational amplifier 501 will be high, thus turning on transistors 523 and 513. However, if a current drawn by two-wire transmitter 10 becomes large enough to cause a voltage at positive input 510 of operational amplifier 501 to approach the voltage on conductor 520, operational amplifier 501 will enter its active region, thus reducing the voltage at the gate of transistor 523 and reducing a current through resistors 524, 525, and 526. The decrease in voltage across resistor 526 will bring transistor 513 out of saturation. As a result, current drawn by the remaining circuitry of two-wire transmitter 10 will be limited, and the voltage at positive input 510 of operational amplifier 501 will be approximately equal to the voltage on conductors 520 and 521. Thus, current drawn by two-wire transmitter 10 is held at a predetermined level (as determined by Zener diode 504 and resistors 103, 502, and 503) until current required by two-wire transmitter 10 decreases below the predetermined limit.

When the voltage on terminal 527 rises to one-half volt above the voltage at conductor 518, diode 514 begins to conduct. As a result, the voltage at conductor 518 is one-half half volt below terminal 527. Because the voltage at the gate of transistor 506 is limited by Zener diode 504, transistor 506 is turned off as is transistor 507. Therefore, current limiting circuit 500 is powered from the high-efficiency voltage regulator circuit 100, exclusively.

The predetermined limiting current is calculated as:

$$I_{limit}==V_{ref}*R503*R502),$$

where $V_{ref}$ is Zener diode voltage, and the R103, R502, and R503 are resistances of resistors 103, 502, and 503, respectively. It is desirable to make $I_{limit}$ sufficiently smaller than 20 milliamperes, in order to prevent the worst-case startup current from exceeding that level. It is, however, necessary for the loop current to be able to exceed 20 mA in normal operation to facilitate calibration (as discussed above). This is achieved by applying a positive voltage at terminal 528 after normal operation is achieved. This turns on transistor 515, thus turning off transistor 505. As a result, the voltage on conductor 520 rises until it approaches the voltage on conductor 518. The voltage on conductor 519 will also rise until it is sufficiently less than the voltage on conductor 518 in order to limit the conduction of transistors 506 and 507. With no power supplied to operational amplifier 501, its output 512 becomes an open circuit. Resistor 529 pulls up the gate of transistor 523, which in turn saturates transistor 513.

If needed, current limiting circuit 500 can be disabled by a signal at the gate of transistor 515 which will cause transistor 505 to turn off. Turning off transistor 505 causes circuit common 511 to be removed from current limiting circuit 500, and thus from the remainder of the two-wire transmitter circuitry. Once circuit common 511 is removed transistor 506 will turn off because a voltage divider forms between resistors 508 and 516. With transistor 506 off, transistor 507 will also be off. Resistor 517 then discharges the base of transistor 507 allowing for a quick turn off.

Figure 6:
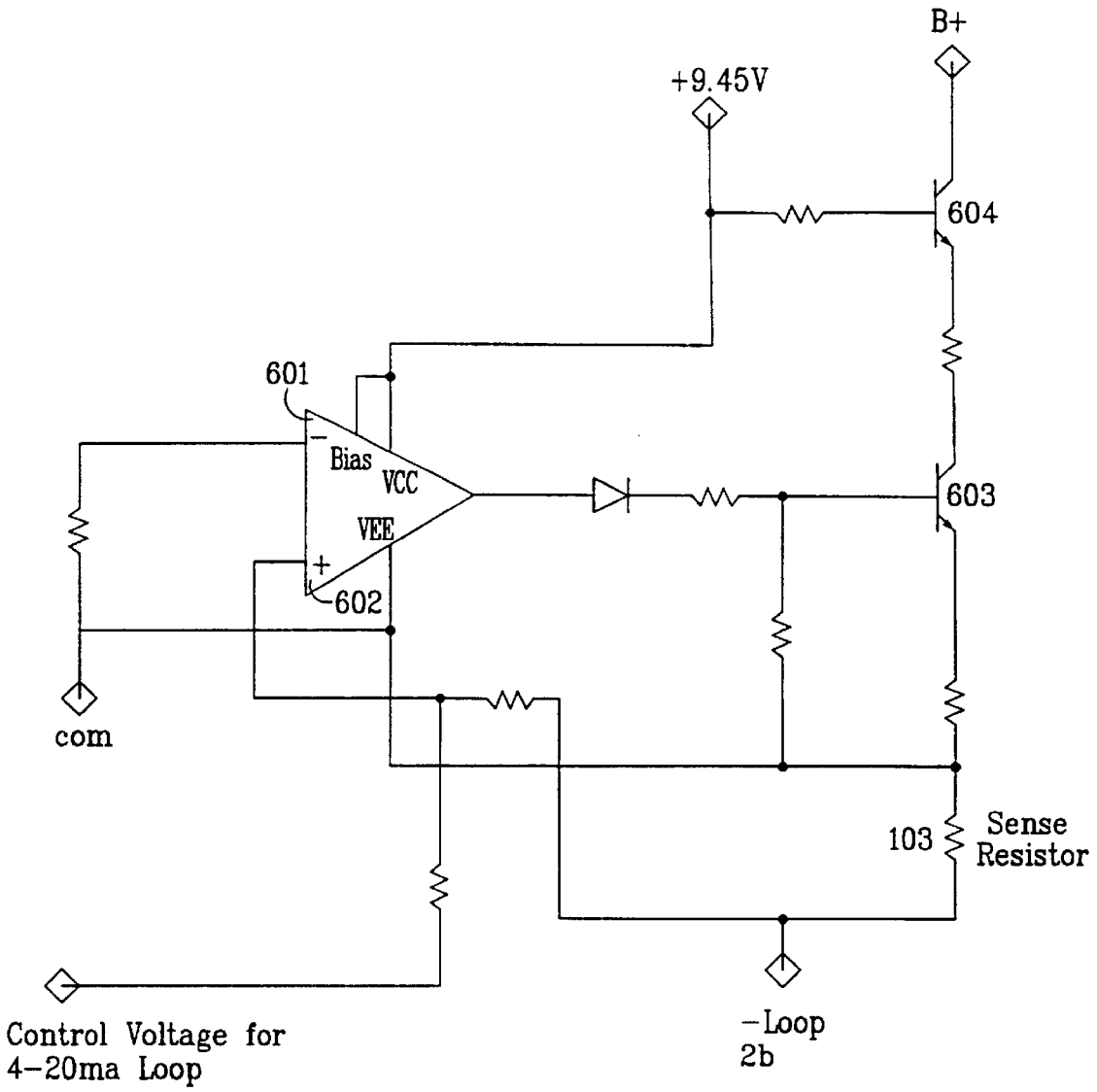
FIG. 6 is schematic diagram of an output amplifier circuit.

FIG. 6 is a detailed schematic of a common output amplifier circuit 404 well-known in the art. Operational amplifier 601 monitors current across the sense resistor 103. When the voltage on positive terminal 602 of operational amplifier 601 is greater than the voltage across the sense resistor 103, operational amplifier 601 biases transistor 603 such that current will travel from supply line 403. Transistor 604 is always on when transistor 603 is on, because the base of transistor 604 is connected to regulated voltage 402.

Figure 7:
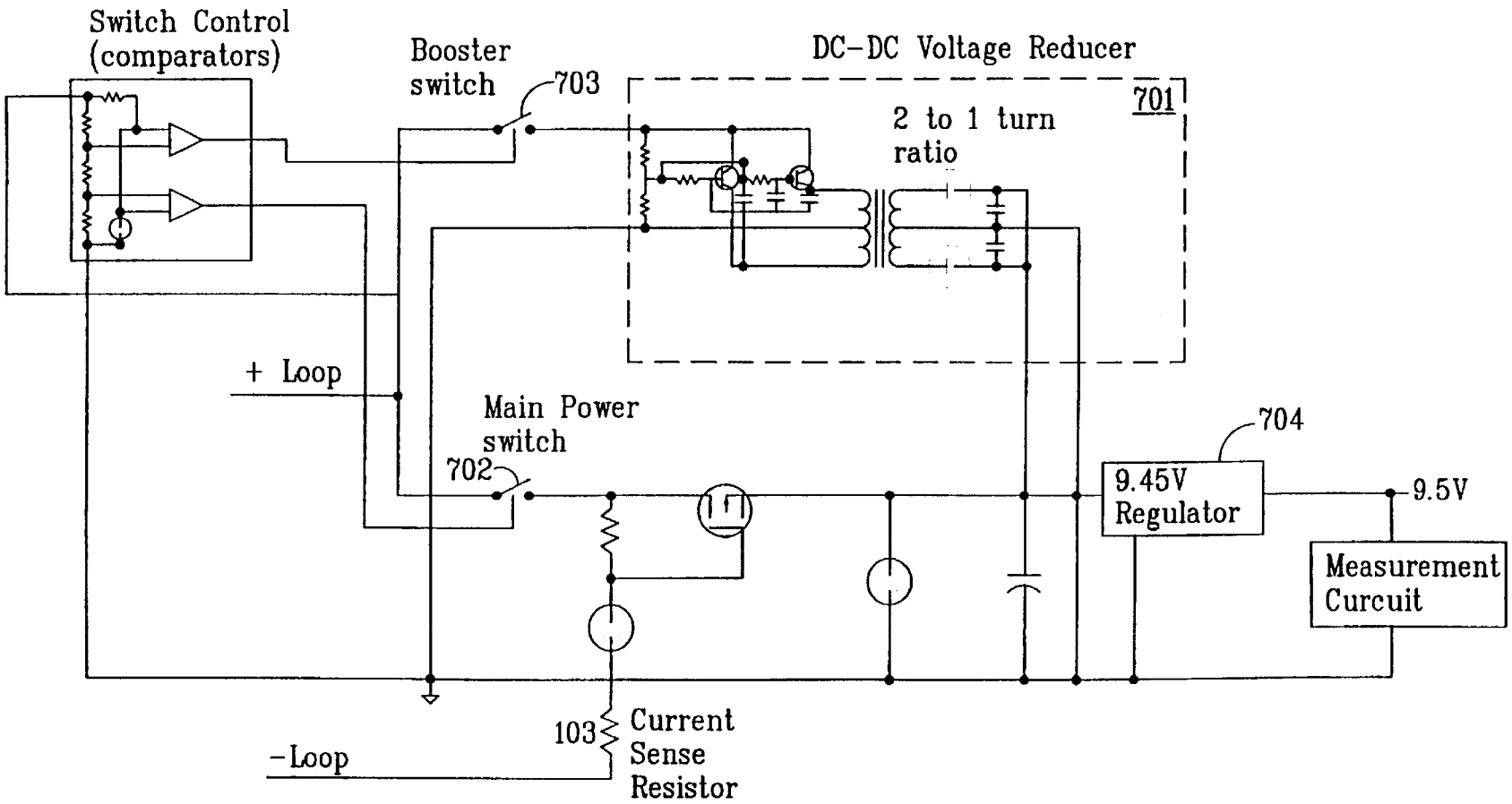
FIG. 7 shows another embodiment of the present invention using a transformer device in the two-wire transmitter device.

FIG. 7 shows another embodiment of the present invention using a transformer 701. In this case, there are two power supplies (not shown) that are switched depending on loop voltage. When the loop current $I_1$ (shown in FIG. 1) increases, terminal voltage $V_t$ decreases, and power is drawn through main power switch 702. Because the input voltage is close to the clamped voltage little power is wasted when the loop current drops and input voltage rises and the power is drawn through booster switch 703 into transformer 701. For example with a 24 volt supply and a 500 ohm series resistance, when the transmitter is signaling 4 milliamps terminal voltage $V_t$ would be approximately 20 volts. Therefore, if transformer 701 has two-to-one turn ratio of two, the voltage into measuring circuit 102 would be 10 volts and the current would be 7 milliamperes, for a total power of 70 milliwatts. Switch 702 may be an enhancement mode transistor, while switch 703 may be a depletion mode transistor, such that only one pre-regulator is on at startup. Operational amplifiers (not shown) could control the switching of the two pre-regulators by measuring the voltage across current sensing resistor 103. A switching power supply 704 would be a preferred to supply power.

Figure 8:
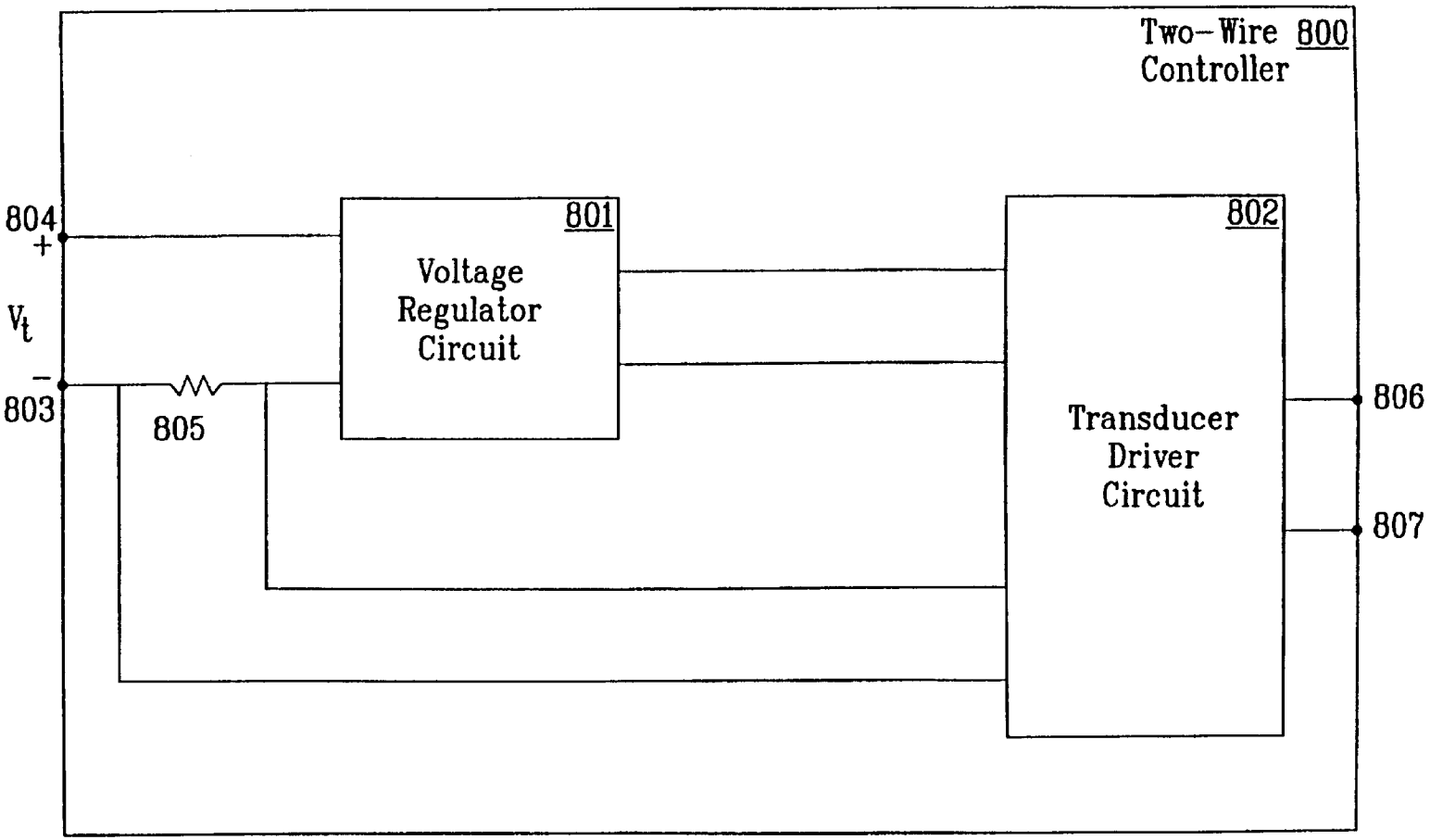
FIG. 8 is a block diagram of a two-wire controller according to the present invention.

FIG. 8 shows a block diagram of two-wire controller 800. Two-wire controller 800 comprises a voltage regulator circuit 801 and a transducer driver circuit 802. Voltage regulator circuit 801 couples directly to terminal 804 of two-wire controller 800, and couples through a sense resistor 805 to terminal 803 of two-wire controller 800. In addition, voltage regulator circuit 801 is coupled to transducer driver circuit 802. Transducer driver circuit 802 is coupled in parallel to sense resistor 805. Transducer driver circuit 802 also is coupled to terminals 806 and 807 of two-wire controller 800.

When two-wire controller 24 receives a signal from programmable controller 32 (as shown in FIG. 1), transducer driver circuit 802 measures a corresponding voltage $V_t$ across sense resistor 805. Transducer driver circuit 802 receives power from voltage regulator circuit 801, which as described for two-wire transmitter 10 above, comprises a non-linear regulator. Because non-linear circuits regulate voltage and current more efficiently than linear regulator circuits, more power is available to transducer driver circuit 802. Accordingly, transducer driver circuit 802 has an increased capacity for responding to measured voltage Vr across sense resistor 805.

Those skilled in the art will recognize that while a preferred embodiment of the invention has been fully disclosed and described, improvements and modifications are possible without departure from its essential spirit and scope, and still continue to fulfill the needs of the art and objects of the invention described above. The scope of the invention should therefore not be construed as limited by the preceding exemplary disclosure, but only by the following claims.

What is claimed is:

1. A process control device, comprising:

a measuring circuit that produces a control signal indicative of a measured value;

a power regulator circuit coupled to said measuring circuit such that said power regulator circuit does not limit available power to said measuring circuit; and two or more conductors in electrical communication with said power regulator circuit, wherein said conductors deliver said available power to said power regulator circuit, and wherein said conductors receive a first electric signal from said power regulator circuit.

2. The process control device of claim 1, further comprising a power control circuit coupled to said measuring circuit and to said conductors, wherein said power control circuit redirects a portion of said available power from said power regulator circuit in proportion to said control signal, and wherein said power control circuit delivers a second electric signal to said conductors.

3. The process control device of claim 1, wherein said power regulator circuit comprises a current limiting circuit for reducing current surges present when said process control device begins operating.

4. The process control device of claim 1, wherein said power regulator circuit comprises a non-linear, power regulator.

5. The process control device of claim 1, wherein said power regulator circuit comprises an inductive element.

6. The process control device of claim 1, wherein said power regulator circuit comprises a switching regulator.

7. The process control device of claim 1, wherein said power regulator circuit comprises an electrical transformer adapted to select between two sources of electrical power.

8. The process control device of claim 2, wherein said power control circuit comprises a voltage to current converter.

9. The process control device of claim 1, wherein said control signal is an electric voltage.

10. The process control device of claim 1, wherein said measured value is provided by a sensor.

11. The sensor of claim 8, wherein said sensor is a transducer.

12. The process control device of claim 1, wherein said first electric signal and said second electric signal are electric currents, in the range of 4–20 milliamperes.

13. The process control device of claim 1, wherein said available power is provided by a direct-current power source.

14. A method for use in a process control system, comprising:

receiving power;

regulating said power with a power regulator circuit to a first value to operate a measuring circuit, wherein said regulation does not limit said power to said measuring circuit; and providing a first control signal produced by said measuring circuit to operate an indicator.

15. The method as recited in claim 14, further comprising providing to a power control circuit a second control signal produced by said measuring circuit.

16. The method as recited in claim 14, further comprising limiting current surges present when said process control system begins operating.

17. The method as recited in claim 14, wherein said power regulator circuit comprises a non-linear, power regulator.

18. The method as recited in claim 14, wherein said power regulator circuit comprises an inductive element.

19. The method as recited in claim 14, wherein said power regulator circuit comprises a switching regulator.

20. The method as recited in claim 14, wherein said power regulator circuit comprises an electrical transformer adapted to select between two sources of electrical power.

21. The method as recited in claim 15, wherein said power control circuit comprises a voltage to current converter.

22. The method as recited in claim 15, wherein said second control signal is an electric voltage.

23. The method as recited in claim 14, wherein said first control signal is an electric voltage.

24. The method as recited in claim 14, wherein said electric signal is an electric current, in the range of 4–20 milliamperes.

25. The method as recited in claim 14, wherein said power is provided by a direct-current power source.

26. A process control system, comprising:

a sensor adapted to determine a measured value;

a process control device in electrical communication with said sensor, comprising:

a measuring circuit that produces a control signal indicative of said measured value; and a power regulator circuit coupled to said measuring circuit such that said power regulator circuit does not limit available power to said measuring circuit;

a power source coupled to said process control device by two or more conductors, wherein said conductors deliver said available power from said power source to said process control device, and wherein said conductors receive an electric signal from said process control device; and an indicating device coupled to said power source and said process control device, wherein said indicating device describes said electric signal.

27. The process control system of claim 26, wherein said process control device further comprises a power control circuit coupled to said measuring circuit, wherein said power control circuit redirects an amount of said available power from said power regulator circuit in proportion to said control signal.

28. The process control system of claim 26, wherein said power regulator circuit comprises a current limiting circuit for reducing current surges present when said process control device begins operating.

29. The process control system of claim 26, wherein said power regulator circuit comprises a non-linear, power regulator.

30. The process control system of claim 26, wherein said power regulator circuit comprises an inductive element.

31. The process control system of claim 26, wherein said power regulator circuit comprises a switching regulator.

32. The process control system of claim 26, wherein said power regulator circuit comprises an electrical transformer adapted to select between two sources of electrical power.

33. The process control system of claim 27, wherein said power control circuit comprises a voltage to current converter.

34. The process control system of claim 26, wherein said control signal is an electric voltage.

35. The process control system of claim 26, wherein said sensor is a transducer.

36. The process control system of claim 26, wherein said electric signal is an electric current, in the range of 4–20 milliamperes.

37. The process control system of claim 26, wherein said available power is provided by a direct-current power source.

* * * * *

UNITED STATES PATENT AND TRADEMARK OFFICE

CERTIFICATE OF CORRECTION

PATENT NO. : 6,388,431 B1
DATED : May 14, 2002
INVENTOR(S) : Kramer et al.

It is certified that error appears in the above-identified patent and that said Letters Patent is hereby corrected as shown below:

Column 8,
Line 57, please delete "Vr" and insert therefor -- $V_r$ --.

Signed and Sealed this

Eighth Day of April, 2003

JAMES E. ROGAN
*Director of the United States Patent and Trademark Office*